US006805330B2

(12) United States Patent
Bush

(10) Patent No.: US 6,805,330 B2
(45) Date of Patent: Oct. 19, 2004

(54) FLUSH-MOUNT RETROFIT FLUID CONTROL SWITCH

(75) Inventor: Shawn D. Bush, Seminole County, FL (US)

(73) Assignee: I-CON Systems, Inc., Oviedo, FL (US)

( * ) Notice: Subject to any disclaimer, the term of this patent is extended or adjusted under 35 U.S.C. 154(b) by 356 days.

(21) Appl. No.: 10/038,630

(22) Filed: Jan. 3, 2002

(65) Prior Publication Data

US 2003/0122097 A1 Jul. 3, 2003

(51) Int. Cl.[7] ..... F16K 31/02
(52) U.S. Cl. ..... 251/129.04; 4/406
(58) Field of Search ..... 251/129.01, 129.04; 4/406, 410, 668, 675, 676, 677; 236/12.11, 12.12

(56) References Cited

U.S. PATENT DOCUMENTS 6,018,827 A 2/2000 Shaw et al. ..... 4/664

RE37,888 E * 10/2002 Cretu-Petra ..... 236/12.12

* cited by examiner

*Primary Examiner*—Edward K. Look
*Assistant Examiner*—John K. Fristoe, Jr.
(74) *Attorney, Agent, or Firm*—Webb Ziesenheim Logsdon Orkin & Hanson P.C.

(57) ABSTRACT

The present invention is a fluid control switch which includes an adapter element for engagement with a switch housing assembly in a fluid control system. The switch housing assembly has a switch orifice surrounded by a switch orifice rim. The adapter element also includes an activation portion in communication with a signal switch, which creates a analog/digital data signal when the activation portion is activated. When the adapter element is engaged with the switch housing assembly, the activation portion of the adapter element extends at least flush with the switch orifice rim of the switch housing assembly.

17 Claims, 6 Drawing Sheets

FLUSH-MOUNT RETROFIT FLUID CONTROL SWITCH

BACKGROUND OF THE INVENTION

1. Field of the Invention

The present invention relates generally to fluid control switches, and, in particular, to fluid control switches for use in connection with electronically-triggered flow valves and fluid control systems.

2. Brief Description of the Prior Art

In most fluid control systems, and more particularly, water conduit systems, control valves are utilized to control the flow of water through the piping system. Further, in prison lavatory and water closet systems, these control valves are typically used in connection with electronic control centers, which contain sensor inputs to register a user's request for operation of the flow valve. It is these valves, typically solenoid-operated valves, that control the flow of water to the user.

In the area of prison lavatory and water closet systems, conventional manually-operated prison lavatory flow valves, in particular, piston valves, are typically converted to allow for electronic control. Typically, the piston valve is triggered by a user depressing an external button or switch located on the switch housing assembly. Further, the switch is connected to a rod and the rod is connected to a lever on the mechanical valve. It is this mechanical flow valve that controls the flow of fluid, typically water, through the valve, and further through the remaining piping system. When used in connection with a sink, when a user depresses the switch, the rod activates the valve, such that water is allowed to flow through the valve and out of the faucet into the sink. Due to the impurities in potable water, the tiny metering hole associated with the mechanical valve will often clog or be altered in size causing the length of time of fluid flow to be insufficient or the length of time to be further extended, wasting water. In addition, such a mechanical piston flow valve, and control valves associated with these types of flow valves, have numerous and separately functioning pieces. The assembly, maintenance and repair of such a valve having many pieces is difficult, expensive and time consuming.

In order to overcome the deficiencies of using a mechanical flow valve, electronically-controlled flow valves have been developed. In these systems, the external button or switch remains connected to a rod, with the rod activating a switch which is in communication with a communication line which, in turn, is in communication with an external control unit. It is this external control unit that controls a control valve, which controls the flow valve, thereby controlling fluid flow through the flow valve. Such systems, however, still require mechanical operation to activate. Specifically, the user must "push" the button to activate the switch to create the appropriate data signal, which is transmitted to the external control unit. As with the above-described mechanical flow valve, this electronically-controlled flow valve, in particular, the push button-operated switch housing assembly, is subject to mechanical failure and tampering. Additionally, after repeated activation, such a push button assembly begins to "wear" and lose effectiveness, eventually becoming completely inoperable.

SUMMARY OF THE INVENTION

It is, therefore, an object of the present invention to provide a fluid control switch having a minimum number of "pieces," thereby reducing expense and maintenance costs. It is another object of the present invention to provide a fluid control switch that uses no movable parts, which are subject to wear and tampering. It is a further object of the present invention to provide a fluid control switch that does not require any significant plumbing alterations prior to its installation. It is a further object of the present invention to provide a fluid control switch that is particularly adapted for retrofitting a typical switch housing assembly in a fluid control system.

Accordingly, the present invention is directed to a fluid control switch that includes an adapter element, adapted to be engaged with a switch housing assembly in a fluid control system. The switch housing assembly has a switch orifice surrounded by a switch orifice rim. The adapter element also includes an activation portion, which is in communication with a signal switch. The signal switch creates a data signal when the activation portion is activated. When the adapter element is engaged with the switch housing assembly, the activation portion of the adapter element extends at least flush with the switch orifice rim of the switch housing assembly.

The present invention also includes a method for retrofitting a fluid control switch to a switch housing assembly. The switch housing assembly includes a switch orifice with inner walls having threads disposes thereon and surrounded by a rim. The method includes providing an adapter element having an activation portion in communication with a signal switch, and mating the adapter element with the switch orifice such that the activation portion of the adapter element extends at least flush with the rim of the switch housing assembly. The adapter element may include an outer surface with threads disposed thereon for threaded engagement with the threads on the inner walls of the switch orifice. Alternatively, the adapter element may be mated with a fitting which has a threaded outer surface. In such an embodiment, mating of the adapter element with the switch orifice is accomplished by threading the threads of the fitting with the threads of the switch orifice, such that the activation portion extends at least flush with the rim.

The method may further include receiving an analog data signal from the activation portion of the adapter element, converting the analog data signal to a digital data signal by an analog/digital signal converter and transmitting the digital data signal to an external control unit via a communication line, such as a phone line or a local area network line. The method may further include steps of receiving the digital data signal by the external control unit, transmitting a data signal to a control valve instructing the control valve to allow fluid to flow through a flow valve, and allowing fluid to flow through the flow valve and further through a faucet. The data signal may further be terminated, thereby disallowing further fluid flow.

The present invention is further directed to a kit for a fluid control system including a flow valve in fluid communication with a faucet and a control valve, an external control unit in communication with a control valve, and a fluid control switch having an adapter element configured to be engaged with a switch housing assembly as described herein.

The present invention, both as to its construction and its method of operation, together with the additional objects and advantages thereof will best be understood from the following description of specific embodiments when read in connection with the accompanying drawings.

DETAILED DESCRIPTION OF THE PREFERRED EMBODIMENTS

Figure 1:
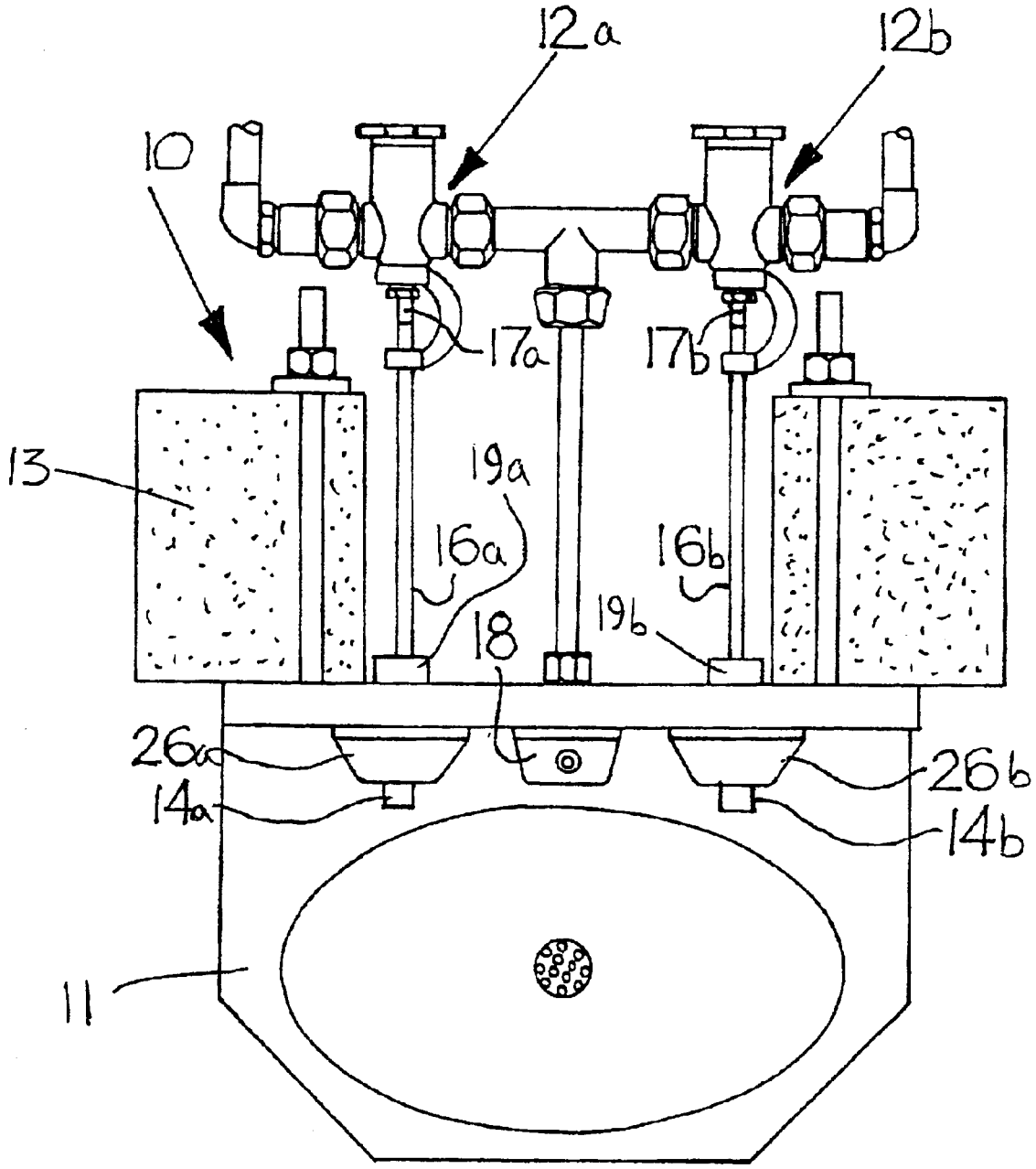
Fig. 1 PRIOR ART
FIG. 1 is a top view of a typical prior art fluid control system using mechanical flow valves.

With reference to the attached Figures in which like reference numerals refer to like elements throughout the several views thereof, FIG. 1 illustrates a typical prior art fluid control system 10, such as for operation and fluid flow in connection with a lavatory sink 11, using mechanical flow valves 12*a* and 12*b* for controlling the flow of hot and cold running water, respectively. In this prior art system, the lavatory sink 11 and the mechanical flow valves 12*a* and 12*b* are typically separated from each other through a wall 13. Mechanical push buttons 14*a* and 14*b* are attached to the lavatory sink 11 through switch housing assemblies 26*a* and 26*b* by way of fittings 19*a* and 19*b*, which are typically brass fittings threaded within switch housing assemblies 26*a* and 26*b*, respectively. Mechanical push buttons 14*a* and 14*b* are in operable communication with rods 16*a* and 16*b* which extend through wall 13 and which, in turn, are in operable communication with the mechanical flow valves 12*a* and 12*b*. When the user "pushes" one of the mechanical push buttons 14*a* and/or 14*b*, the respective rod 16*a* and/or 16*b* activates the mechanical flow valve 12*a* and/or 12*b*, thereby allowing fluid, typically water, to flow through the mechanical flow valve 12*a* and/or 12*b* and out a faucet 18. When the user releases the mechanical push button 14*a* and/or 14*b*, the mechanical flow valve 12*a* and/or 12*b* halts fluid flow through the valve, thereby disallowing any fluid to flow out of the faucet 18.

Figure 2:
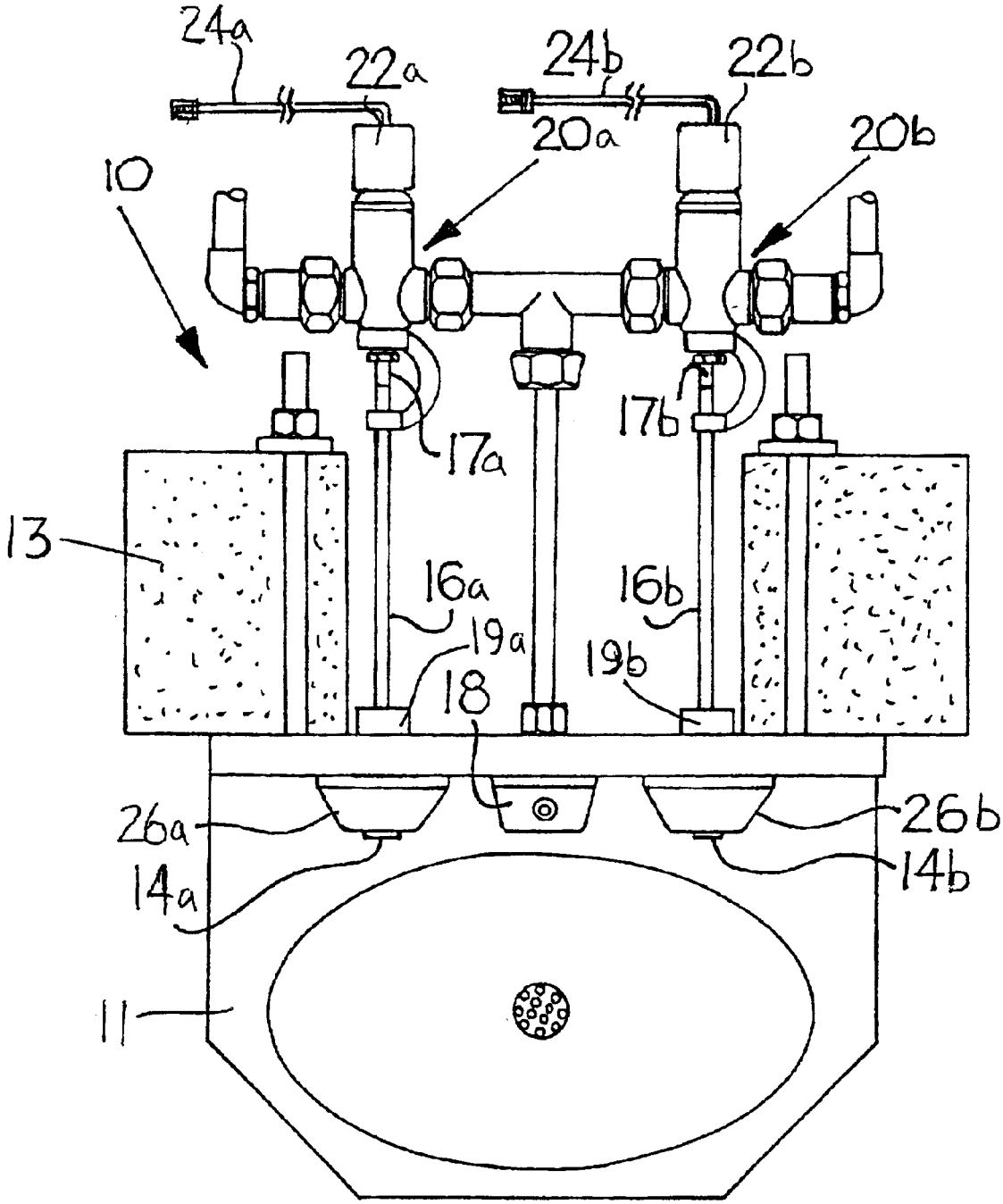
Fig. 2 PRIOR ART
FIG. 2 is a top view of a typical prior art fluid control system using electronically-controlled flow valves.

In an effort to update and remove the mechanical flow valves 12*a* and 12*b* from the fluid control system 10, electronically-operated flow valves 20*a* and 20*b* have been developed, as seen in FIG. 2. These electronically-operated flow valves 20*a* and 20*b* are controlled by control valves 22*a* and 22*b*, respectively, which are in communication with an external control unit (not shown) via communication lines 24*a* and 24*b*. As seen in FIG. 2, this prior art fluid control system 10 still utilizes mechanical push buttons 14*a* and 14*b* attached to a respective rod 16*a* and 16*b* to produce an appropriate signal for communication to the external control unit. As with the above prior art installation, when the mechanical push button 14*a* and/or 14*b* is depressed, the attached rod 16*a* and/or 16*b* activates a switch 17*a* and/or 17*b*, and a signal is communicated to the external control unit, which then transmits a signal to the control valves 22*a* and/or 22*b* via the communication line 24*a* and/or 24*b*. As discussed above, the repeated use of these mechanical push buttons 14*a* and 14*b* and attached rods 16*a* and 16*b* "wears" the assembly, eventually rendering them inoperable. Further, since the mechanical push buttons 14*a* and 14*b* extend beyond switch housing assemblies 26*a* and 26*b*, they are subject to tampering and abuse. Moreover, since the rods 16*a* and 16*b* activate the switches 17*a* and 17*b*, respectively, repair of the assembly requires substantial time to access the switches 17*a* and/or 17*b*.

Figure 3:
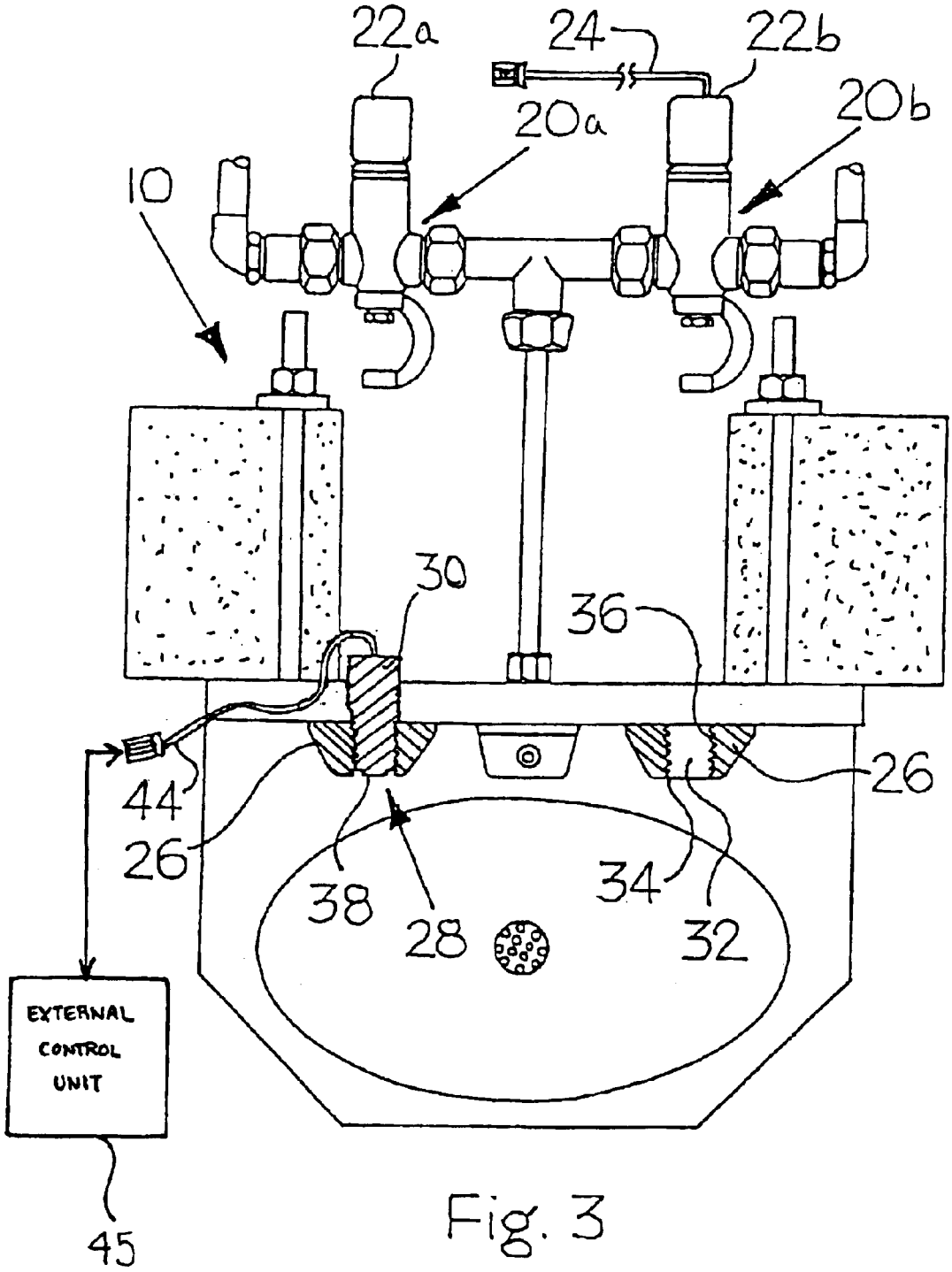
FIG. 3 is a top view of a fluid control system using the fluid control switch according to the present invention.

In order to overcome these deficiencies, the fluid control switch 28 of the present invention is provided for use in connection with a switch housing assembly, such as switch housing assemblies 26*a* and 26*b*. As seen in FIG. 3, the fluid control switch 28 does not employ a mechanical push button 14*a* or 14*b*, or a rod 16*a* or 16*b* for operation of the control valves 22*a* or 22*b*. It is noted that FIG. 3 depicts only one fluid control switch 28 assembled with switch housing assembly 26 for illustration purposes. It is noted that lavatory sink 11, such as is depicted in FIG. 3, would typically employ separate fluid control switches for hot and cold running water, as described above in connection with the mechanical assemblies of FIGS. 1 and 2. Also, it is contemplated that a single fluid control switch may be integrated with two separate control valves, such as 22*a* and 22*b* of FIGS. 1 and 2, such that hot and cold water can be supplied to the faucet 18 through activation of a single fluid control switch.

The fluid control switch 28 includes an adapter element 30 for engagement with the switch housing assembly 26. As seen in FIG. 3, the switch housing assembly 26 has a switch orifice 32 surrounded by a switch orifice rim 34. The switch orifice 32 is defined by switch orifice inner walls 36 having threads disposed thereon. It is contemplated that switch housing assembly 26 can be constructed of one or more pieces to provide the appropriate design configuration.

Figure 5:
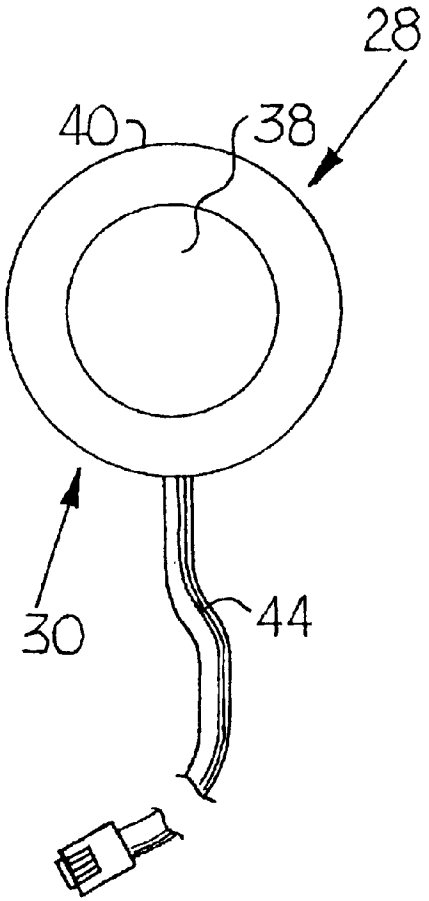
FIG. 5 is a top view of the fluid control switch of FIG. 4.
Figure 4:
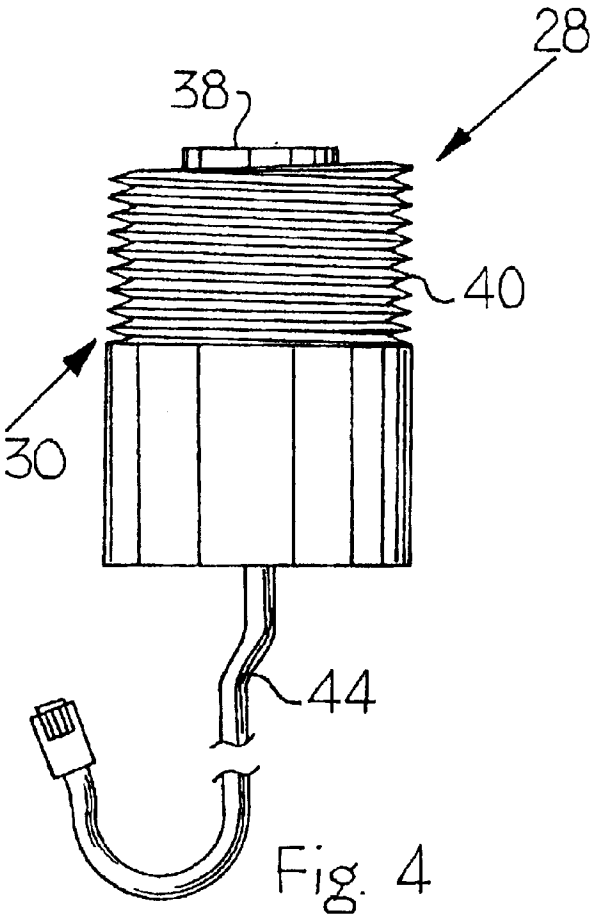
FIG. 4 is a side view of a fluid control switch according to the present invention.

As illustrated in FIGS. 4 and 5, the adapter element 30 has an activation portion 38 integrally formed therewith and an adapter element outer surface 40 with threads disposed thereon. While both the switch orifice 32 of the switch housing assembly 26 and the adapter element outer surface 40 have threads, it is envisioned that any method of mating the fluid control switch 28 to the switch housing assembly 26 in a non-permanent manner is contemplated. For example, the adapter element 30 may be connected to the switch housing assembly 26 via a friction fit. When the adapter element 30 is engaged with the switch housing assembly 26, the activation portion 38 of the adapter element 30 extends at least flush with the switch orifice rim 34 of the switch housing assembly 26. In this manner, the activation portion 38 can be activated by a user's wrist, since the activation portion 38 extends at least flush and possibly beyond the switch housing assembly 26.

Figure 6:
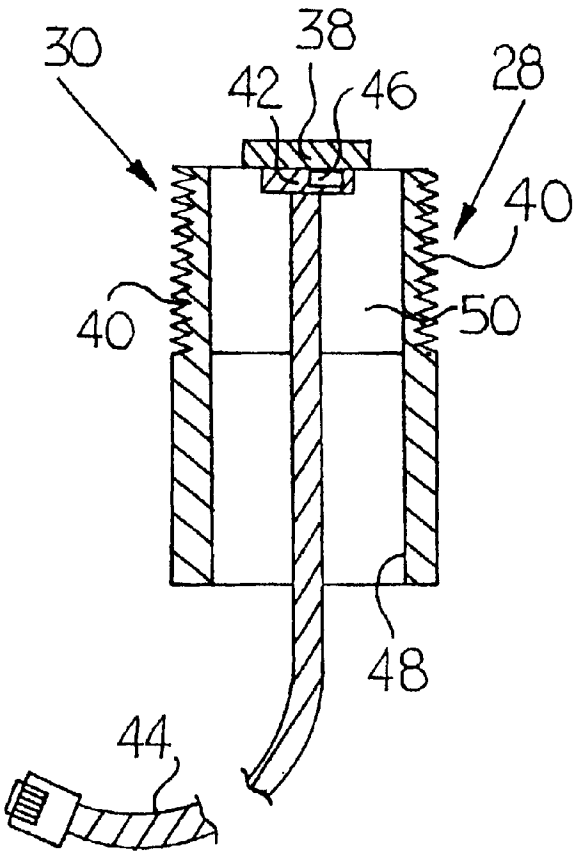
FIG. 6 is a side sectional view of a preferred embodiment of a fluid control switch according to the present invention.

As illustrated in FIG. 6, the activation portion 38 is in communication with, or integrated with, a signal switch 42. The signal switch 42 produces a data signal based on some activity surrounding the activation portion 38 of the adapter element 30. This data signal is then transmitted through the adapter element communication line 44 to an external control unit 45 (See FIG. 3). It is envisioned that the signal switch 42 may also include an analog/digital signal converter 46 for converting an analog signal received from the activation portion 38 to a digital signal. For example, when the operation signal is created through a user's pressure on the activation portion 38 of the adapter element 30, when the user "touches" the activation portion 38, the analog data signal received by the signal switch 42 is a pressure signal. Next, the analog signal is converted to a digital signal by the analog/digital signal converter 46 and transmitted through the adapter element communication line 44 to an external control unit 45. Similarly, if the activation signal is heat, when a user touches the activation portion 38, the analog data signal of heat is converted by the analog/digital signal converter 46 to a digital signal and, as above, passed to the external control unit 45 through the communication line 44.

As the typical prior art switch housing assembly 26 uses a tubular switch orifice 32, it is envisioned that the adapter element 30, as well as the activation portion 38 of the adapter element 30, are tubular in shape and particularly adapted to engage the switch orifice 32. Further, the data signal which emanates from the signal switch 42 and, if present, the analog/digital signal converter 46, may be passed through the adapter element communication line 44, which may be a phone line or a local area network line, whichever is suitable in operating the system and in communicating with the external control unit 45.

In order to protect the signal switch 42, the adapter element 30 may also include an adapter element chamber 48 adapted to house a signal switch medium 50. The signal switch medium 50 may be used to secure the signal switch 42 adjacent the activation portion 38 of the adapter element 30. Further, the signal switch medium 50 may also be manufactured from a conductive material, such that any data signal emanating from the signal switch 42 travels through the signal switch medium 50 and into the adapter element communication line 44. Still further, this signal switch medium 50 may be used to isolate the signal switch 42 and protect it from moisture and other outside forces.

As the signal switch 42 and the activation portion 38 are integrated with the adapter element 30, the overall structure of the adapter element 30 is unitary. This allows for easy installation and maintenance of the fluid control switch 28, and allows for simple retro-fitting of fluid control switch 28 with existing fluid control systems. Also, it is envisioned that the adapter element 30 may be manufactured from stainless steel, carbon steel, or any other material that is suitable both aesthetically and operably with the switch housing assembly 26, typically already present in the fluid control system 10.

In operation, when the fluid control switch 28 is engaged with the switch housing assembly 26, a user need only touch the activation portion 38 of the adapter element 30, which allows the signal switch 42 to produce a data signal. The data signal is transmitted to an external control unit 45 which then activates a control valve 22, thereby allowing fluid to flow through the electronically-operated flow valve 20, and further through the faucet 18 associated with the switch housing assembly 26. Since the fluid control switch 28 is engaged such that the activation portion 38 is flush with or extends slightly beyond the switch orifice rim 34, the activation portion 38 can be easily accessed by a finger or wrist of a user. Further, since the activation portion 38 is not a mechanical push button 14, it has no moving parts, and is not subject to wear-and-tear.

The present invention also includes a method for retrofitting a fluid control switch 28 to a switch housing assembly 26. In such a retrofitting operation, both the fluid control switch 28 and the switch housing assembly 26 are conventional parts as described above. The method includes threading the adapter element 30 with the switch orifice 32 via the switch orifice threads and the adapter element threads, such that the activation portion 38 of the adapter element 30 extends at least flush with the switch orifice rim 34 of the switch housing assembly 26.

Figure 7:
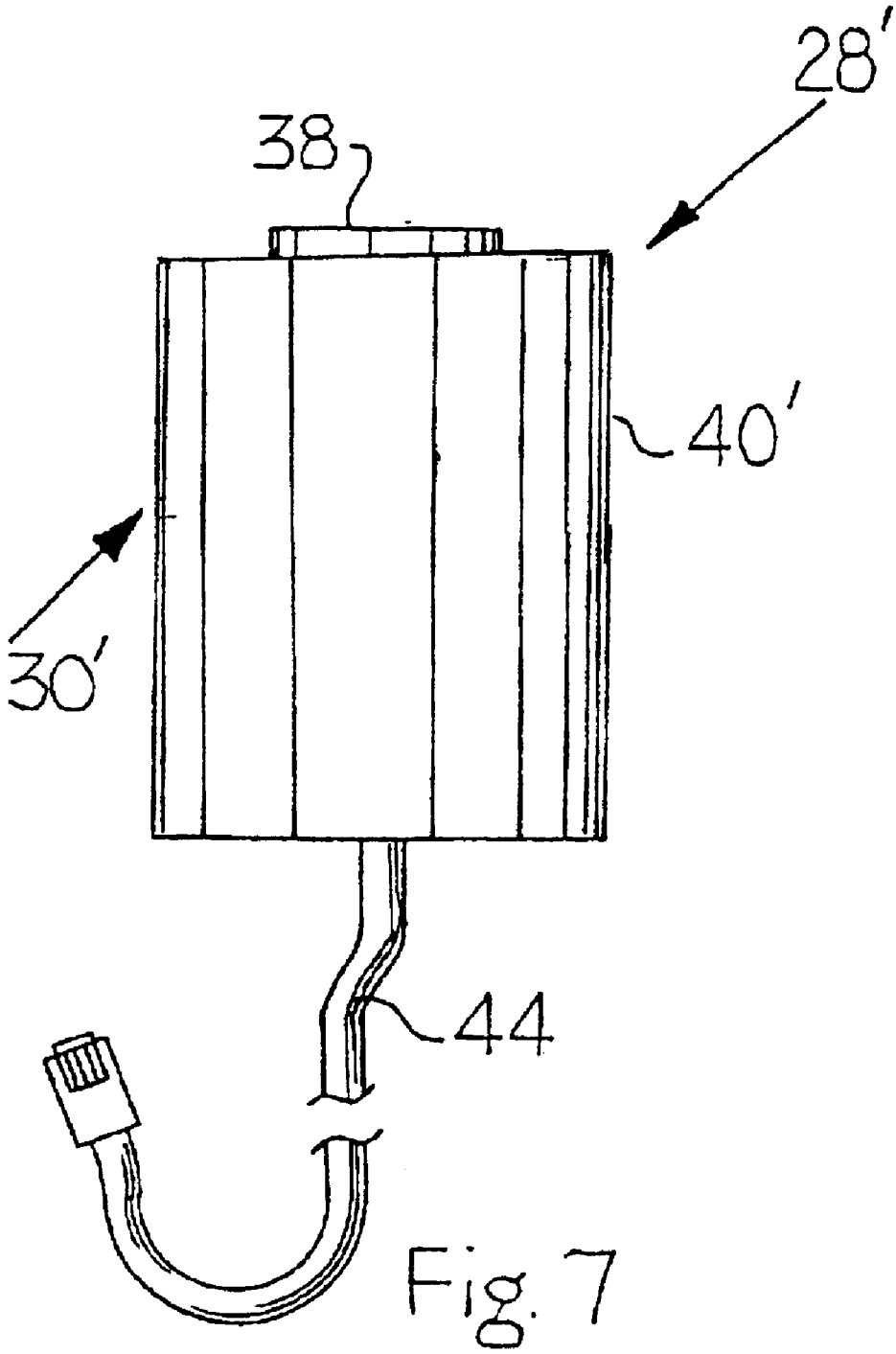
FIG. 7 is a side view of a fluid control switch in an alternate embodiment of the present invention.
Figure 8:
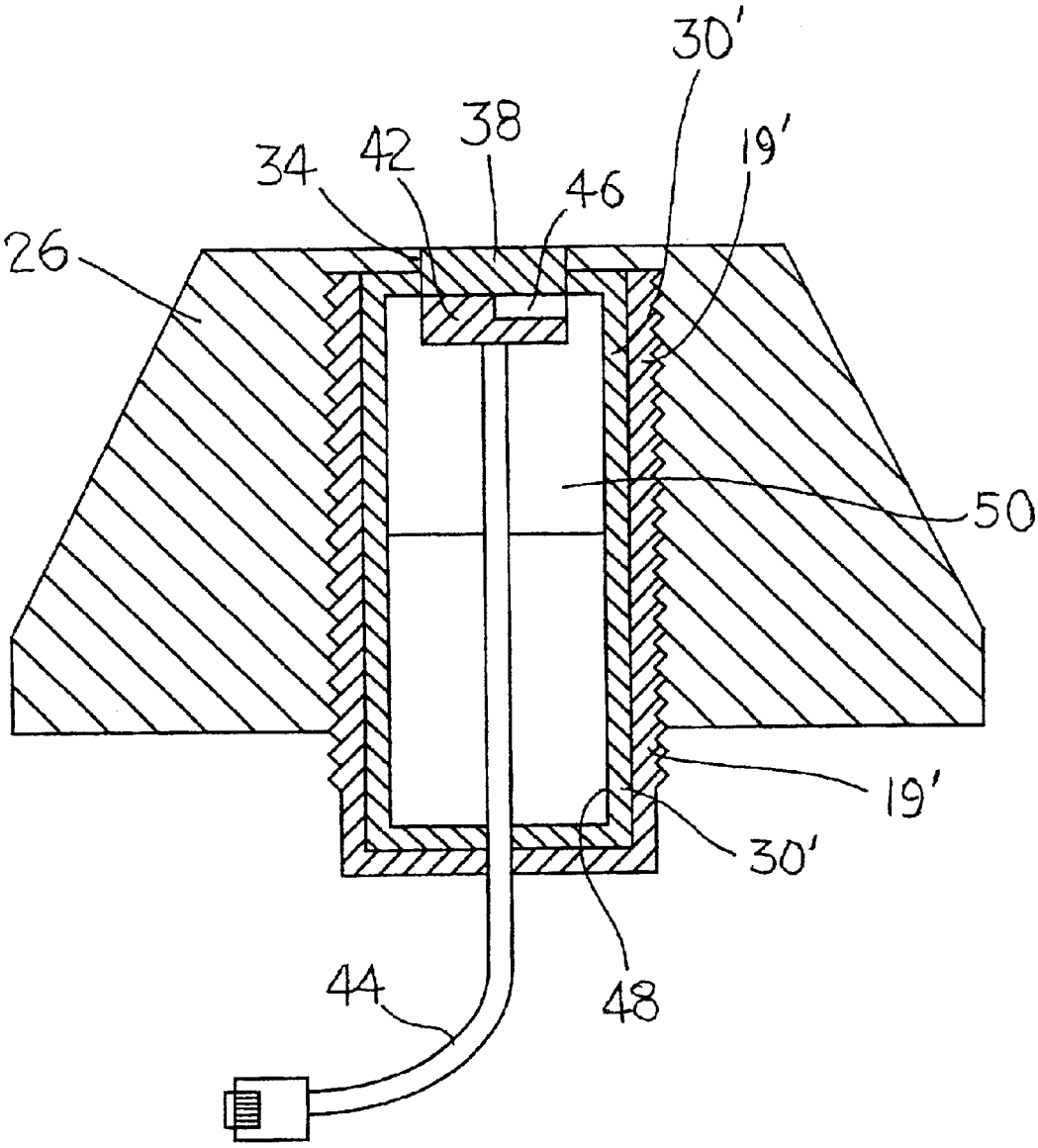
FIG. 8 is a side sectional view of the fluid control switch of FIG. 7 shown assembled with a fitting and housing assembly.

In a further embodiment as shown in FIGS. 7 and 8, the fluid control switch 28' includes adapter element 30' for use in fluid control system 10. Adapter element 30' is particularly useful in retrofitting existing fluid control systems having a conventional mechanical push button and rod assembly attached to a switch housing assembly 26 through a conventional brass fitting, as described herein with respect to FIGS. 1 and 2. Adapter element 30' includes an adapter element outer surface 40'. Adapter element outer surface 40' in the present embodiment, however, does not include any threads disposed thereon for threaded engagement with switch housing assembly 26 as discussed above. Instead, in the embodiment of FIGS. 7 and 8, adapter element 30' is meant for use with a fitting, such as a conventional brass fitting 19'. As such, the adapter element outer surface 40' of adapter element 30' does not include any structure for direct interfitting engagement with switch housing assembly 26, but is instead provided for frictional engagement between the switch housing assembly 26 and fitting 19'.

More particularly, as depicted in FIG. 8, adapter element 30' is adapted to mate with fitting 19' such as by sitting within fitting 19', with adapter element communication line 44 extending from adapter element 30' through an opening in the fitting 19' which would normally be present for rod 16 in prior art assemblies as discussed above. During assembly, the fluid control switch 28' including adapter element 30' as described is provided within fitting 19'. Fitting 19' is then threaded within switch housing assembly 26. Such threading causes the fluid control switch 28' to contact with switch housing assembly 26 adjacent switch orifice rim 34, with the activation portion 38 extending at least flush with the switch housing assembly 26. In this manner, fluid control switch 28' can be used in a retrofit installation with a conventional brass fitting to replace an existing mechanical valve.

The present invention is simple in its use and easy in its manufacture. Further, the lack of moving parts and components in the fluid control switch 28 eliminates the possibility of excessive use resulting in wear and damage. Since the activation portion 38 is integrally formed with the adapter element 30, the present invention fluid control switch 28 cannot be easily tampered with by the user. Also, since the activation portion 38 is designed to extend through the wall of the switch housing assembly 26 to be at least flush with the switch orifice rim 34, the activation portion 38 can be easily activated by a user's wrist, thereby meeting federal guidelines for accessibility. While the present invention is equally useful in new installations, it is particularly useful in retrofit situations. Moreover, since the control valves 22 are operated electronically and do not require any extension for activation by a push rod 16, the control valve 22 can also be retrofitted with an electronically-controlled valve designed for use in such retrofit applications.

This invention has been described with reference to the preferred embodiments. Obvious modifications and alterations will occur to others upon reading and understanding the preceding detailed description. It is intended that the invention be construed as including all such modifications and alterations.

What is claimed is:

1. A fluid control switch, comprising:

an adapter element configured to be engaged with a switch housing assembly in a fluid control system, the switch housing assembly having a switch orifice surrounded by a switch orifice rim; and the adapter element further comprising an activation portion in communication with a signal switch, the signal switch creating a data signal when the activation portion is activated, the activation portion and the signal switch arranged within the switch housing assembly such that the activation portion of the adapter element extends at least flush with the switch orifice rim of the switch housing assembly, when engaged therewith, wherein the signal switch further comprises an analog/digital signal converter configured to convert an analog signal, which is at least one of heat and pressure, received from the activation portion of the adapter element, to a digital signal; and wherein the activation portion creates the data signal through contact without the use of moving parts, such that the activation portion is a non-mechanical activation portion.

2. The fluid control switch of claim 1, further comprising a communication line in communication with the signal switch and configured to transmit a data signal emanating from the signal switch to an external control unit.

3. The fluid control switch of claim 2, wherein the communication line is one of a phone line and a local area network line.

4. The fluid control switch of claim 1, further comprising a signal switch medium configured to secure the signal switch adjacent the activation portion of the adapter element.

5. The fluid control switch of claim 1, wherein the adapter element further comprises an adapter element outer surface having threads disposed thereon, the adapter element threads configured to mate with corresponding threads disposed on switch orifice inner walls.

6. The fluid control switch of claim 1, wherein the adapter element is a unitary structure.

7. The fluid control switch of claim 1, wherein the adapter element is manufactured from a material selected from stainless steel and carbon steel.

8. The fluid control switch of claim 1, wherein the signal switch and the adapter element produces a data signal which, when transmitted to an external control unit, activates a control valve, thereby allowing fluid to flow through a flow valve, and further through a faucet associated with the switch housing assembly.

9. A method for retrofitting a fluid control switch to a switch housing assembly having a switch orifice with switch orifice inner walls having threads disposed thereon and surrounded by a switch orifice rim, comprising the steps of:

providing an adapter element having an activation portion in communication with a signal switch that creates a data signal when the activation portion is activated, wherein the signal switch further comprises an analog/digital signal converter configured to convert an analog signal, which is at least one of heat and pressure, received from the activation portion of the adapter element, to a digital signal, and wherein the activation portion creates the data signal through contact without the use of moving parts, such that the activation portion is a non-mechanical activation portion; and arranging the activation portion and the signal switch within the switch housing assembly, such that the activation portion extends at least flush with the switch orifice rim of the switch housing assembly.

10. The method as in claim 9, wherein the adapter element includes an outer surface with threads disposed thereon, and said mating of said adapter element with the switch orifice comprises threading the threads of the adapter element with the threads on the inner walls of the switch orifice.

11. The method as in claim 9, wherein said mating step comprises:

mating the adapter element with a fitting having an outer surface with threads disposed thereon; and threading the threads of the fitting with the threads of the switch orifice, such that the activation portion of the adapter element extends at least flush with the switch orifice rim of the switch housing assembly.

12. The method of claim 9, further comprising the steps of:

receiving an analog data signal from the activation portion of the adapter element; and converting the analog data signal to a digital data signal by the analog/digital signal converter.

13. The method of claim 12, further comprising the step of:

transmitting the digital data signal to an external control unit via a communication line.

14. The method of claim 13, wherein the communication line is one of a phone line and a local area network line.

15. The method of claim 13, further comprising the steps of:

receiving the digital data signal by the external control unit;

transmitting a data signal to a control valve instructing the control valve to allow fluid to flow through a flow valve; and allowing fluid flow through the flow valve and further through a faucet associated with the switch housing assembly.

16. The method of claim 15, further comprising the steps of:

terminating the data signal to the control valve; and disallowing further fluid through the flow valve and the faucet.

17. A kit for a fluid control system, comprising:

a flow valve in fluid communication with a faucet and a control valve;

an external control unit in communication with the control valve; and a fluid control switch having an adapter element configured to be engaged with a switch housing assembly having a switch orifice surrounded by a switch orifice rim, the adapter element further comprising an activation portion in communication with a signal switch, which creates a data signal when the activation portion is activated, and a communication line in communication with the signal switch and configured to transmit the data signal emanating from the signal switch to the external control unit, wherein the activation portion and the signal switch are arranged within the switch housing assembly, such that the activation portion extends at least flush with the switch orifice rim of the switch housing assembly;

wherein the signal switch further comprises an analog/digital signal converter configured to convert an analog signal, which is at least one of heat and pressure, received from the activation portion of the adapter element, to a digital signal;

wherein the activation portion creates the data signal through contact without the use of moving parts, such that the activation portion is a non-mechanical activation portion;

wherein when the signal switch of the adapter element produces a data signal and the data signal is transmitted to the external control unit via the communication line, a second data signal is transmitted to the control valve, activating the control valve, thereby allowing fluid to flow through the flow valve, and further through the faucet associated with the switch housing assembly.

* * * * *